US007333930B2

(12) United States Patent
Baumgarte

(10) Patent No.: US 7,333,930 B2
(45) Date of Patent: Feb. 19, 2008

(54) TONAL ANALYSIS FOR PERCEPTUAL AUDIO CODING USING A COMPRESSED SPECTRAL REPRESENTATION

(75) Inventor: Frank Baumgarte, Berkeley Heights, NJ (US)

(73) Assignee: Agere Systems Inc., Allentown, PA (US)

( * ) Notice: Subject to any disclaimer, the term of this patent is extended or adjusted under 35 U.S.C. 154(b) by 957 days.

(21) Appl. No.: 10/389,000

(22) Filed: Mar. 14, 2003

(65) Prior Publication Data

US 2004/0181393 A1 Sep. 16, 2004

(51) Int. Cl.
*G10L 19/00* (2006.01)

(52) U.S. Cl. ..... 704/200.1; 704/500

(58) Field of Classification Search ..... 704/200.1, 704/500

See application file for complete search history.

(56) References Cited

U.S. PATENT DOCUMENTS

| | | | | |
|---|---|---|---|---|
| 3,681,530 | A * | 8/1972 | Manley et al. | 704/203 |
| 4,209,843 | A * | 6/1980 | Hyatt | 708/422 |
| 5,583,962 | A * | 12/1996 | Davis et al. | 704/229 |
| 5,632,003 | A * | 5/1997 | Davidson et al. | 704/200.1 |
| 5,649,052 | A * | 7/1997 | Kim | 704/226 |
| 5,699,479 | A * | 12/1997 | Allen et al. | 704/205 |
| 5,701,352 | A * | 12/1997 | Williamson, III | 381/104 |
| 5,809,453 | A * | 9/1998 | Hunt | 704/214 |
| 5,918,203 | A | 6/1999 | Herre et al. | |
| RE36,714 | E | 5/2000 | Brandenburg et al. | |
| 2002/0133345 | A1* | 9/2002 | Garudadri | 704/256 |
| 2003/0158727 | A1* | 8/2003 | Schultz | 704/207 |
| 2004/0057701 | A1* | 3/2004 | Tsai et al. | 386/96 |

OTHER PUBLICATIONS

William C. Treurniet and Darcy R. Boucher, "A Masking Level Difference Due to Harmonicity", J. Acoust. Soc. Am. vol. 109 (1), Jan. 2001, pp. 306-320.

Painter and Spanias, "Perceptual Coding of Digital Audio", Proceedings of the IEEE, vol. 88, No. 4, Apr. 2000, pp. 449-513.

* cited by examiner

*Primary Examiner*—David Hudspeth
*Assistant Examiner*—Justin W. Rider
(74) *Attorney, Agent, or Firm*—Steve Mendelsohn

(57) ABSTRACT

The present invention provides an apparatus, method and tangible medium storing instructions for determining tonality of an input audio signal, for selection of corresponding masked thresholds for use in perceptual audio coding. In the various embodiments, the input audio signal is sampled and transformed using a compressed spectral operation to form a compressed spectral representation, such as a cepstral representation. A peak magnitude and an average magnitude of the compressed spectral representation are determined. Depending upon the ratio of peak-to-average magnitudes, a masked threshold is selected having a corresponding degree of tonality, and is used to determine a plurality of quantization levels and a plurality of bit allocations to perceptually encode the input audio signal with a distortion spectrum beneath a level of just noticeable distortion (JND). The invention also includes other methods and variations for selecting substantially tone-like or substantially noise-like masked thresholds for perceptual encoding of the input audio signal.

43 Claims, 11 Drawing Sheets

TONAL ANALYSIS FOR PERCEPTUAL AUDIO CODING USING A COMPRESSED SPECTRAL REPRESENTATION

FIELD OF THE INVENTION

The present invention relates, in general, to perceptual coding of digital audio and, more particularly, to perceptual coding of input audio signals utilizing tonality analysis.

BACKGROUND OF THE INVENTION

Audio coding or audio compression algorithms are used to obtain compact digital representations of high-fidelity (wideband) audio signals for the purpose of efficient transmission or storage. The central objective in audio coding is to represent the signal with a minimum number of bits while achieving transparent signal reproduction, i.e., generating output audio that cannot be distinguished from the original input, even by a sensitive listener.

Types of perceptual audio coding have been developed which achieve coding gain by exploiting both perceptual irrelevancies and statistical redundancies. Perceptual irrelevancies, for example, allow for certain distortion levels which are inaudible (and therefore irrelevant) because of masking by appropriate audio-signal levels. Psychoacoustic signal analysis is often utilized to estimate such audio signal masking power based on psychoacoustic principles. Such a psychoacoustic model delivers masked thresholds that quantify the maximum amount of allowable distortion at each point in the time-frequency plane such that quantization of time-frequency parameters does not introduce audible artifacts, allowing quantization in encoding to exploit perceptual irrelevancies and provide an improved coding gain.

A wide variety of methods have been utilized to determine the nature of any input audio signal to estimate the masked threshold. Among other techniques, most known methods make a distinction between tone-like and noise-like components of the audio signal, referred to herein as "tonality". Depending on this classification, the masked threshold level is significantly different. Thus, the allowable distortion level depends on the tonality of the audio signal components. Some known methods to estimate the tonality include a spectral flatness measure, use of complex spectral coefficients, loudness uncertainty measures, and envelope fluctuation measures.

In a spectral flatness measure, the input audio spectrum is examined to determine whether there are distinct peaks, and if so, the input audio signal is considered to be most likely tonal, while if the input audio spectrum is generally flat, the input audio signal is considered to be largely noise-like. Complex spectral coefficients also may be utilized, in which spectral coefficients from one frame to the next are predicted and/or examined to determine whether the variation is primarily in the nature of phase shifts, and if so, the input audio signal is considered tone-like. Loudness uncertainty measures determine loudness variations over time, with fluctuations in loudness indicative of a noise-like input signal. Similarly, envelope fluctuations may also be utilized to examine various energy levels in sub-bands, where significant fluctuation is again indicative of a noise-like signal.

Such prior art methods, however, have proved unreliable if the input spectrum is largely harmonic, having fundamental frequencies with overtones, such as in music and speech. Such prior art methods also have proved unreliable, especially with different instruments having different fundamental frequencies or varying fundamental frequencies over time, e.g., vibrato in singing or instrumental sounds.

SUMMARY OF THE INVENTION

The present invention provides a method, apparatus, and tangible medium storing machine-readable software for determining tonality of an input audio signal. The apparatus embodiment includes: (1) a sampler capable of sampling the input audio signal; (2) a psychoacoustic analyzer coupled to the sampler, the psychoacoustic analyzer capable of transforming the sampled input audio signal using a compressed spectral operation to form a compressed spectral representation, determining tonality of the input audio signal from a peak magnitude and an average magnitude of the compressed spectral representation, and selecting a masked threshold corresponding to the tonality of the input audio signal; and (3) a quantizer and encoder capable of utilizing the masked threshold to determine a plurality of quantization levels and a plurality of bit allocations to perceptually encode the input audio signal. The masked threshold may have a linear or non-linear correspondence to a level of tonality of the input audio signal The psychoacoustic analyzer of the invention is further capable of determining that the input audio signal is substantially tone-like when the peak magnitude of the compressed spectral representation is greater than the average magnitude of the compressed spectral representation by a predetermined threshold, and determining that the input audio signal is substantially noise-like when the peak magnitude of the compressed spectral representation is not greater than the average magnitude of the compressed spectral representation by the predetermined threshold.

The quantizer and encoder is further capable of utilizing the masked threshold to encode the sampled input audio signal with a distortion spectrum beneath a level of just noticeable distortion (JND).

In the various embodiments, the compressed spectral operation may includes an autocorrelation operation, an exponential operation with an exponent between zero and 1, or a cepstrum operation. For the cepstrum operation, the psychoacoustic analyzer is further capable of performing a first frequency transformation of the sampled input audio signal into a frequency domain representation; applying a logarithmic operation to the frequency domain representation to form a logarithmic representation; and performing a second frequency transformation of the logarithmic representation to form the compressed spectral representation. The logarithmic operation may be a base ten logarithmic operation or is a natural logarithmic (base e) operation. The first frequency transformation may be a Fourier transformation, a Fast Fourier Transformation (FFT), a discrete cosine transformation, or a z-transformation; while the second frequency transformation may be a Fourier transformation, an inverse Fourier transformation, a Fast Fourier Transformation (FFT), an inverse Fast Fourier Transformation (FFT), a discrete cosine transformation, an inverse discrete cosine transformation, a z-transformation, or an inverse z-transformation.

Numerous other advantages and features of the present invention will become readily apparent from the following detailed description of the invention and the embodiments thereof, from the claims and from the accompanying drawings.

BRIEF DESCRIPTION OF THE DRAWINGS

The objects, features and advantages of the present invention will be more readily appreciated upon reference to the following disclosure when considered in conjunction with the accompanying drawings, in which:

FIG. 2, divided into

DETAILED DESCRIPTION OF THE INVENTION

Figure 1:
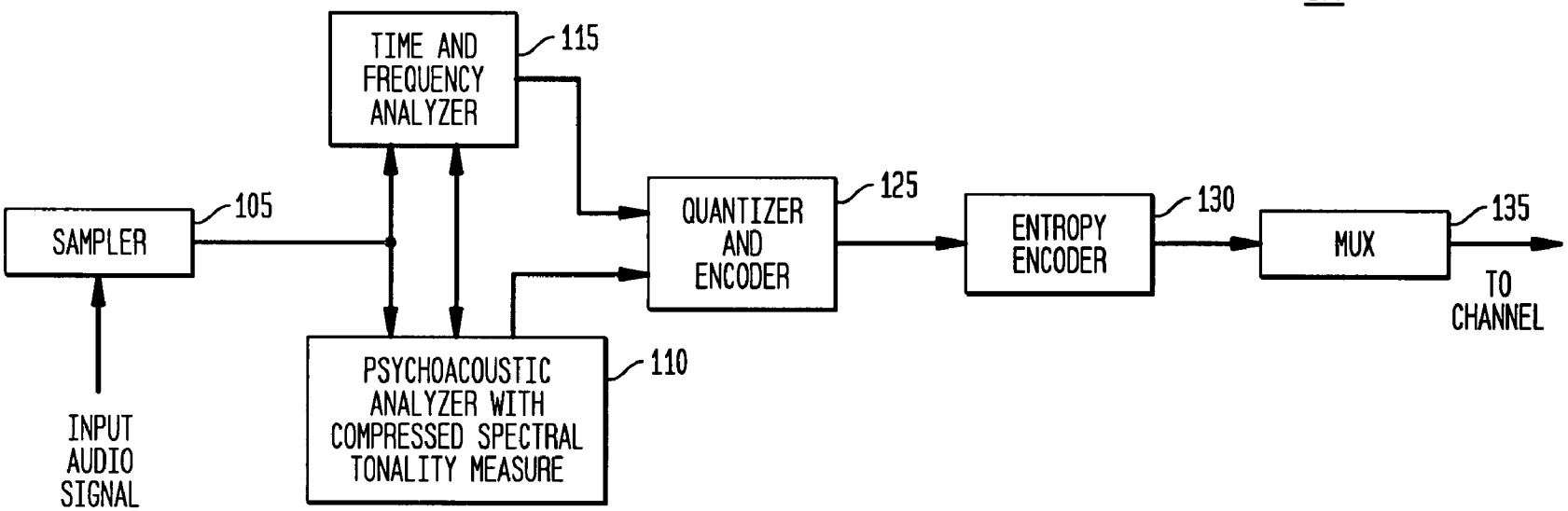
FIG. 1 is a block diagram illustrating an apparatus embodiment of the present invention.

While the present invention is susceptible of embodiment in many different forms, there are shown in the drawings and will be described herein in detail specific embodiments thereof, with the understanding that the present disclosure is to be considered as an exemplification of the principles of the invention and is not intended to limit the invention to the specific embodiments illustrated.

The present invention provides a new and more accurate measure of the tonality of an input audio signal using a measure of the harmonicity of the input audio signal. The tonality of the input audio signal, as measured by its harmonicity, is utilized to select an appropriate masked threshold for allowable distortion levels in perceptual audio coding. As discussed in greater detail below, in accordance with the present invention, an input audio signal (x(t)) is transformed into a frequency domain representation (X(f)), followed by magnitude compression of the frequency domain representation and a second (inverse or forward) transformation. The resulting compressed spectral representation is examined to determine the degree of harmonicity of the input audio signal, with masked thresholds selected accordingly. (It should be noted that harmonicity is one of a plurality of components of tonality; if a signal is harmonic, it is also tonal, but not vise-versa (e.g., a pure sinusoidal signal (at a single frequency) is tonal, but not harmonic, while a signal with a fundamental frequency and overtones is harmonic and tonal).)

FIG. 1 is a block diagram illustrating an apparatus 100 embodiment of the present invention. Depending upon the selected embodiment, the apparatus 100 may be included within a digital audio transmitter or digital audio encoder. In addition, the encoding may be lossless, such that the coding system is able to reconstruct perfectly the samples of the original input signal from the coded (compressed) representation, or may be lossy, in which case the system is incapable of perfect reconstruction of the input audio signal from the coded representation.

As illustrated in FIG. 1, the apparatus 100 embodiment of the present invention includes a sampler 105, a time and frequency analyzer 115, a psychoacoustic analyzer (with a compressed spectral (or cepstrum) tonality measure) 110, a quantizer and encoder 125, an entropy encoder 130, and generally also a multiplexer 135.

Referring to FIG. 1, an input audio signal is sampled by sampler 105 and typically partitioned into quasi-stationary frames ranging from 2 to 50 ms in duration. The sampled frames are then provided as input into the time and frequency analyzer 115 and the psychoacoustic analyzer (with a compressed spectral (or cepstrum) tonality measure) 110. The time/frequency analyzer 115 estimates or otherwise determines the temporal and spectral components of each frame. In the selected embodiment, the time-frequency mapping is matched to the analysis properties of the human auditory system, extracting from the input audio a set of time-frequency parameters that is amenable to quantization and encoding in accordance with a perceptual distortion metric. Depending upon overall system objectives, the time-frequency analysis (of time/frequency analyzer 115) might contain a unitary transform; a time-invariant bank of critically sampled, uniform, or non-uniform band pass filters; a time-varying (signal adaptive) bank of critically sampled, uniform, or non-uniform band pass filters; a harmonic/sinusoidal analyzer; a source-system analysis (LPC/multi-pulse excitation); and a hybrid transform/filter bank/sinusoidal/LPC signal analyzer. The choice of time-frequency analysis methodology will depend upon any selected time and frequency resolution requirements.

Perceptual distortion control is achieved through psychoacoustic signal analysis (by psychoacoustic analyzer 110) that estimates a signal masking power based on psychoacoustic principles. Noise and tone masked thresholds are determined which quantify the maximum amount of distortion at each point in the time-frequency plane such that quantization of the time-frequency parameters does not introduce audible artifacts. The psychoacoustic analyzer 110 therefore allows the quantization and encoding (of quantizer and encoder 125) to exploit perceptual irrelevancies in a time-frequency parameter set. The results from the psychoacoustic analyzer 110 will provide information for quantization levels and bit allocation (for quantizer and encoder 125). The quantizer and encoder 125 can also exploit statistical redundancies through classical techniques such as differential pulse code modulation (DPCM) or adaptive DPCM (ADPCM). Quantization can be uniform or probability density function (PDF)-optimized, and it might be performed on either scalar or vector data. Once a quantized compact parametric set has been formed, remaining redundancies are typically removed through noiseless run length and entropy encoding techniques (by entropy encoder 130), such as Huffman or Lempel, Ziv and Welch (LZW) coding techniques. Because the output of the psychoacoustic distortion control model is signal dependent, most algorithms utilized in apparatus 100 are variable rate. In the selected embodiments, the present invention seeks to achieve transparent quality of audio coding at low bit rates with tractable complexity and manageable delay.

As discussed in greater detail below, the psychoacoustic analyzer 110 of the present invention utilizes a tonality measure based upon a compressed spectral representation (using cepstrum, exponential or autocorrelation operations), as part of a determination as to whether the input audio signal is primarily tonal (harmonic) or primarily noisy. For example, a tone-like signal generally will be highly periodic, while a noise-like signal generally will be irregular and have increased levels of fluctuations. Importantly, however, psychoacoustic testing has indicated that masked thresholds are different for tone-like signals and noise-like signals. This asymmetric masking phenomenon, in which a tone signal may mask a noise signal (up to a first masked threshold), or in which a noise signal may mask a tone signal (up to a second masked threshold), may be exploited by the psychoacoustic analyzer 110 to appropriately shape coding distortion such that it is undetectable by the human auditory system. In more general psychoacoustic experiments, it was found that the masked threshold level for a pure tone probe depends considerably on the "tonality" of the masker. A similar dependency was found for a narrow band noise probe. In accordance with the present invention, for each temporal analysis interval, the psychoacoustic analyzer 110 of the apparatus 100 identifies, across the audio frequency spectrum, noise-like and tone-like components within the audio signal and will apply the appropriate masking relationships in a frequency-specific manner to construct one or more masked thresholds. In the selected embodiments, the masked thresholds comprise an estimate of the level at which quantization noise (as distortion) becomes just noticeable for a well-trained or sensitive listener (referred to as the level of "just noticeable distortion" or "JND"), for the type of input audio signal (primarily tone-like or primarily noise-like, or the degree to which the input audio signal is tone-like or noise-like).

As a consequence, the psychoacoustic analyzer 110 will determine the degree to which an input audio signal is tonal (compared to noisy), or will classify the input audio signal as either primarily noisy or primarily tonal, and then compute appropriate thresholds and shape the distortion (or noise) spectrum to be beneath the JND. Using the masked threshold determined by the psychoacoustic analyzer 110, the quantizer and encoder 125 determines the corresponding quantization levels and bit allocations for quantizing and encoding the sampled input audio signal. This information is further utilized for entropy encoder 130, which further encodes the quantized and encoded audio signal (from quantizer and encoder 125), eliminating perceptual irrelevancies (signal information which is not detectable by a well-trained or sensitive listener) and statistical redundancies. The encoded digital audio signal provided by entropy coder 130, along with side information related to quantization, bit allocation, and other encoding parameters, are provided to multiplexer 135 for output, such as for transmission or storage on any communication channel or medium.

Figure 2A:
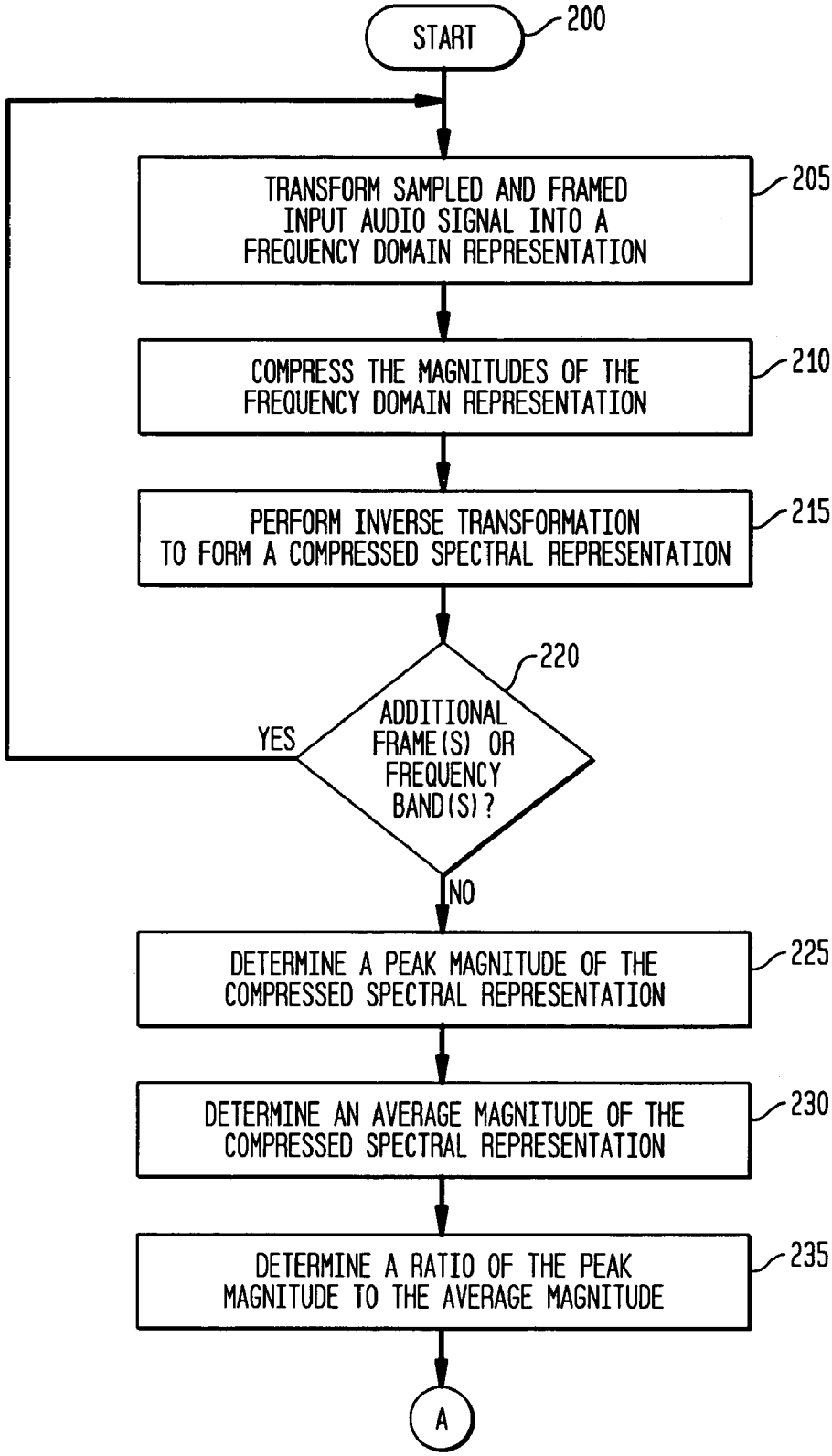
FIGS. 2A, 2B and 2C, is a flow diagram illustrating a method embodiment of the present invention.
Figure 2B:
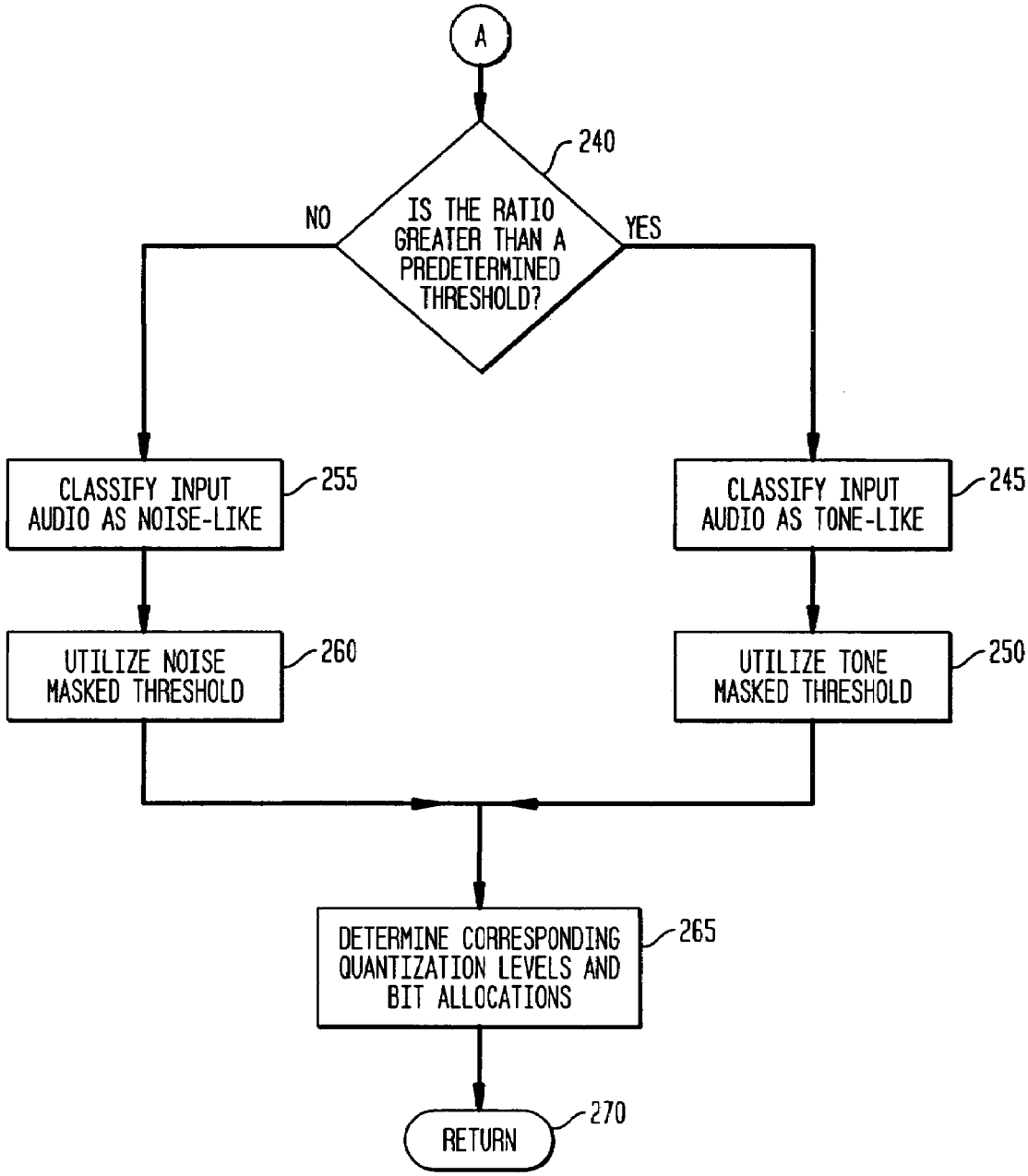
Figure 2C:
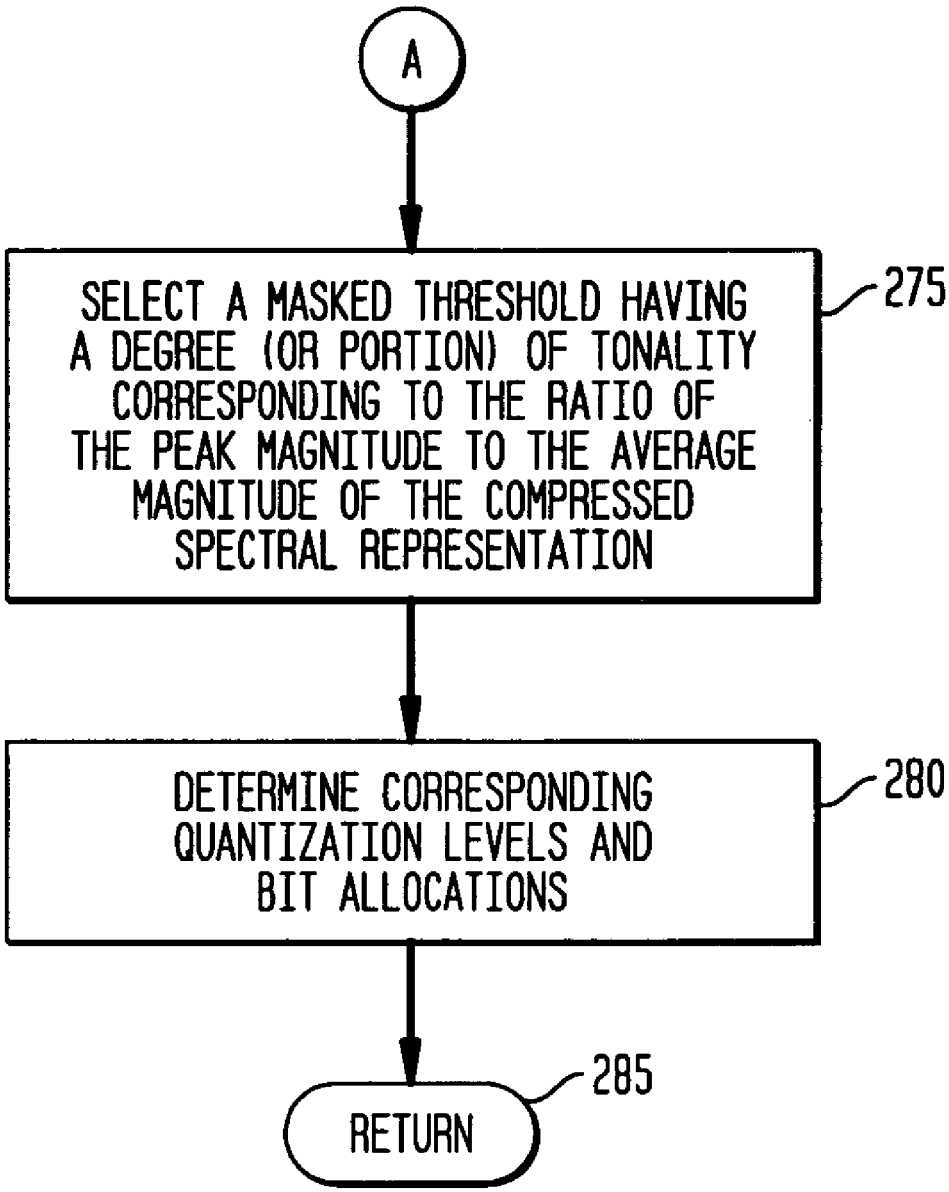

FIG. 2, divided into FIGS. 2A, 2B and 2C, is a flow diagram illustrating various method embodiments of the present invention, with two variations illustrated separately in FIGS. 2B and 2C. The method of the invention is generally performed by the psychoacoustic analyzer 110, and may also use information from the time and frequency analyzer 115. Referring to FIG. 2A, beginning with start step 200, the method transforms sampled and framed input audio signals into a frequency domain representation, step 205. For example, a Fourier transformation, a Fast Fourier Transformation (FFT), a discrete cosine transformation, or a z-transformation may be utilized. An input audio signal x(t) (which also may be represented for explanatory purposes as a convolution of an excitation signal e(t) and a channel, distortion, vocal tract, or other filter h(t) and illustrated as $x(t)=e(t)*h(t)$), having been sampled and framed, may be transformed (such as using a Fourier transformation) into a frequency domain representation X(f) (illustrated as $X(f)=E(f)\cdot H(f)$).

Next, in step 210, a compression of the magnitude of the frequency domain representation X(f) is performed, resulting in a compressed representation, such as by performing a logarithmic (any base), autocorrelation, or exponential (with the exponent between zero and one, e.g., $|X(f)|^{1/2}$ or $|X(f)|^{1/3}$) function or operation. For example, when the compression is performed using a logarithmic operation, the frequency domain representation is transformed into $\log|X(f)|$ (which, secondarily, may also be represented as a superposition of excitation and filter (or other) components having compressed magnitudes, and illustrated as $\log|X(f)|=\log|E(f)|+\log|H(f)|$). During this process, the compression of the magnitudes of the frequency components results in less variance (smaller variations) in the magnitudes (i.e., compression) of the compressed representation, compared to greater variance (larger variations) in the magnitudes of the frequency domain representation (i.e., for $|X(f)|$ greater than or equal to 1, var $\log|X(f)|<\mathrm{var}|X(f)|$), as the greater magnitudes are compressed comparatively more than the lesser magnitudes of the frequency components. (It should be noted for completeness that while this relation holds for $|X(f)|$ greater than or equal to 1, the spectrum may be arbitrarily scaled or smaller magnitudes may be rounded to one to maintain this variance inequality).

(Depending upon the type of input audio signal and various distortion or channel effects, this compression also may result in a (mathematical) deconvolution of the excitation signal e(t) and the filter h(t), and if appropriately windowed, the result may include a separation of higher frequencies (high pass) and lower frequencies (low pass). To the extent $\log|E(f)|$ and $\log|H(f)|$ are separable, the methodology of the present invention may provide these additional advantages. It should be noted, however, that the excitation signal and filter signal are generally unknown and the spectra E(f) and H(f) usually overlap and are inseparable; as a consequence, the frequency transformations and magnitude compressions (and second (inverse or forward) transformations discussed below) of the excitation and filter signals are generally not calculated separately from the frequency transformation of the input audio signal x(t) and the compression (and second (inverse or forward) transformation) of the spectral representation of the input audio signal X(f). For purposes of the present invention, all calculations are generally performed beginning with the sampled and framed input audio signal x(t), such that the input audio signal is transformed into a frequency domain representation X(f), magnitude compressed, and then inverse (or forward) transformed (as discussed below) (with the excitation and filter signal discussed for purposes of mathematical explanation).)

Following the compression of the spectral representation, a second (inverse or forward) transformation is then performed, step 215, such as $\Im^{-1}[\log|\Im(x(t))|]$ (for an inverse Fourier transformation or IFFT) or $\Im[\log|\Im(x(t))|]$ (for a forward Fourier transformation or FFT), which also may be represented as a cepstral sequences $\{c_x(n)\}$, (and which also may be illustrated as $\Im^{-1}[\log|\Im(x(t))|]=\Im^{-1}[\log|\Im(e(t))|]+\Im^{-1}[\log|\Im(h(t))|]$, or $\Im[\log|\Im(x(t))|]=\Im[\log|\Im(e(t))|]+\Im[\log|\Im(h(t))|]$ or cepstral sequences $\{c_x(n)\}=\{c_e(n)\}+\{c_h(n)\}$). Again, in many or most instances, the second (inverse or forward) transformation will be performed as $\Im^{-1}[\log|\Im(x(t))|]$ or $\Im[\log|\Im(x(t))|]$ (as the other components may not be known or be separable). This process of transformation of the sampled input audio signal, magnitude compression and second transformation in accordance with the invention is referred to herein as a compressed spectral operation, with the resulting information (such as spectra or sequences from IFFT, FFT, IDCT, DCT, inverse z-transform, z-transform, or cepstrum operations) referred to as a compressed spectral representation.

Following the second (inverse or forward) transformation, such as an inverse (or forward) Fourier transformation or inverse (or forward) discrete cosine transformation, the method determines whether there are additional input audio frames or frequency bands to be transformed for a chosen time frame length, step 220. When there are additional frames or frequency bands, the method returns to step 205, and repeats steps 205, 210, and 215. When there are no further frames or frequency bands for analysis, the method proceeds to step 225, and determines a peak magnitude of the compressed spectral representation (generally across the entire audio spectrum, or alternatively only in selected sub-bands). Next, in step 230, the method determines the average magnitude of the remaining spectrum of the compressed spectral representation of the audio signal. This average magnitude may be determined equivalently in any selected manner as known in probability or statistical theory, such as a simple average or mean, a root-mean-square (RMS), a weighted average, and so on. A ratio of the peak magnitude to the average magnitude is then determined in step 235.

Figure 3:
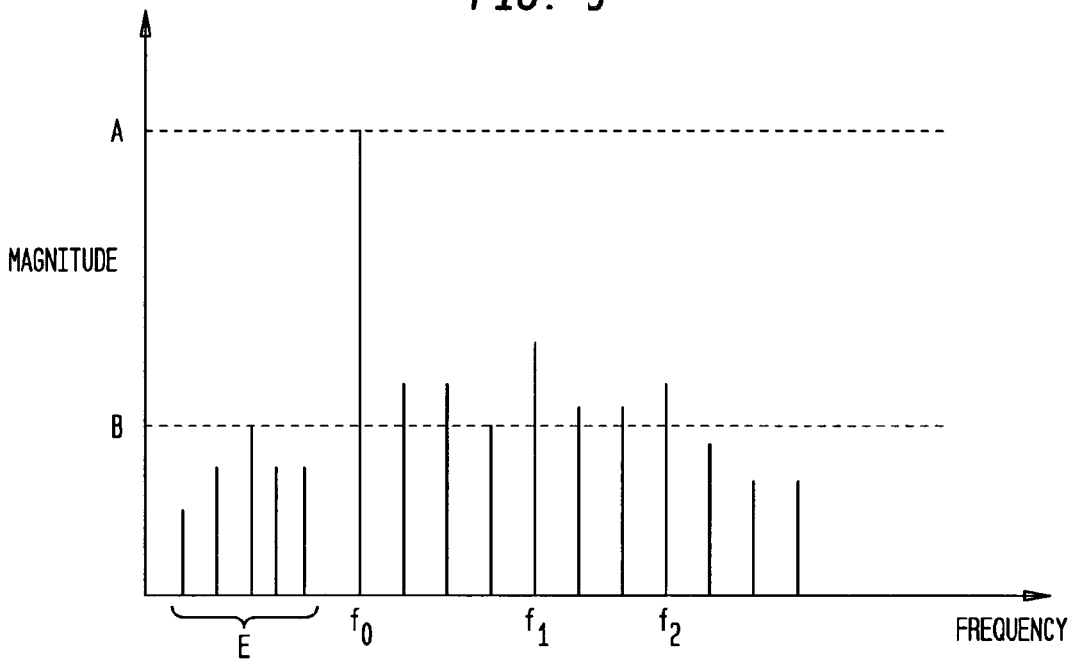
FIG. 3 is a graphical illustration of an exemplary compressed spectral representation of a comparatively more tone-like input signal throughout an audio spectrum.

FIG. 3 is a graphical illustration of an exemplary and simplified compressed spectral representation of a predominantly tone-like input signal, for an audio spectrum. As illustrated, the compressed spectral representation of an exemplary, predominantly tone-like (and harmonic) signal generally will have a significant peak magnitude at a fundamental frequency ($f_0$), along with smaller peaks at harmonic frequencies ($f_1$ and $f_2$) or other resonant frequencies. A ratio of the peak magnitude (A) to an average magnitude of the remaining spectrum (B) illustrates that, in general, this ratio will be greater than 1 (i.e., A>B). FIG. 3 also illustrates a potential separation of low-frequency components (E) and high-frequency components using a low-pass or high-pass window, respectively.

Figure 4:
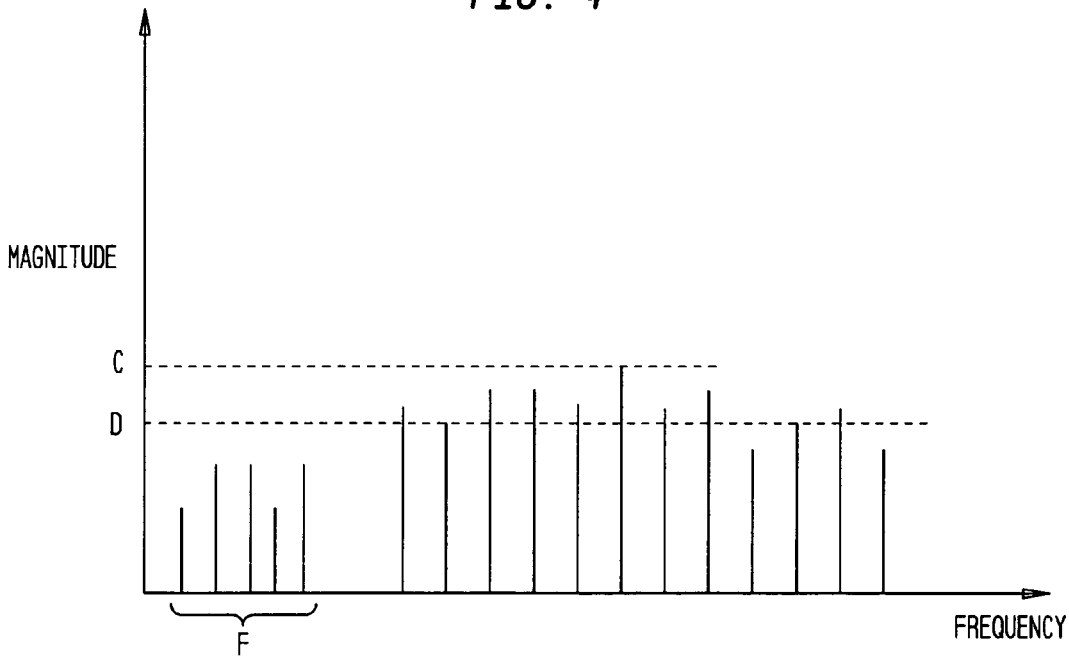
FIG. 4 is a graphical illustration of an exemplary compressed spectral representation of a comparatively more noise-like input audio signal throughout an audio spectrum.

FIG. 4 is a graphical illustration of an exemplary and simplified compressed spectral representation of a noise-like input audio signal, for an audio spectrum. As illustrated in FIG. 4, for an exemplary, predominantly noise-like or non-tonal signal, the peak magnitude (C) is much closer to the average magnitude (D). As such, the ratio of the peak to average magnitudes for a noise-like signal is much closer to a value of 1, (i.e., C≈D). FIG. 4 also illustrates a potential separation of low pass components (F) and high-frequency components, also using a low-pass or high-pass window, respectively.

For a first variation of the methodology of the invention, using a "hard" decision between tone-like and noise-like, following step 235 in which the ratio of the peak to average magnitude of the spectrum of the compressed spectral representation of the input audio signal is determined, referring to FIG. 2B, in step 240, the method determines whether the ratio is greater than a predetermined threshold. For example, in the exemplary illustration of FIGS. 3 and 4, an exemplary predetermined threshold may be in the vicinity of 1.3 (e.g., greater than 1), with more tone-like signals having a ratio greater than the predetermined threshold of 1.3, and more noise-like signals having a ratio less than the predetermined threshold of 1.3. Other equivalent predetermined thresholds will be apparent to and may be utilized by those of skill in the art (e.g., 1.2, 1.15, 1.1, and so on). Following step 240, when the peak-to-average ratio is greater than the predetermined threshold, the method proceeds to step 245 and classifies the input audio as primarily tone-like, and utilizes a tone-masked threshold (for quantizer and encoder 125), step 250. When the ratio of peak-to-average magnitudes is not greater than the predetermined threshold in step 240, the method classifies the input audio signal as primarily noise-like, step 255, and utilizes a noise-masked threshold (for quantizer and encoder 125), step 260. Following steps 250 or 260, in step 265, the method determines the corresponding quantization levels and bit allocations for imperceptible distortion levels (generally, set to a level just less than or beneath JND), and the method may end, return step 270. In general, this method is run continuously, with time-varying tone or noise-masked thresholds, as the input audio signal is generally time varying.

Rather than utilizing hard or strict decisions and masked thresholds for tone-like or noise-like input audio signals, a second variation of the methodology of the invention is illustrated in FIG. 2C. Following step 235 in which the ratio of the peak to average magnitude of the spectrum of the compressed spectral representation of the input audio signal is determined, referring to FIG. 2C, a masked threshold is determined (or selected from a plurality of masked thresholds) which has a degree of tonality corresponding to the ratio of peak-to-average magnitudes of the compressed spectral representation, step 275.

In accordance with the invention, a linear (or non-linear) function may be utilized that relates the ratio (R) of maximum (peak) to average values of the compressed spectral representation to the degree or level of tonality (T) of an input audio signal, such as T=f(R), for appropriate determination of the masked threshold. (Equivalently, such a function may relate the difference between peak and average values (discussed below) to the degree of tonality of an input audio signal.) For example, a masked threshold for greater tonality may be selected or determined for higher peak-to-average magnitude ratios (which are indicative of greater tonality of the input audio signal), while a masked threshold for an intermediate level of tonality may be selected or determined for intermediate peak-to-average magnitude ratios (which are indicative of an intermediate level of tonality of the input audio signal). Correspondingly, a masked threshold for lesser tonality (more noise-like) may be selected or determined for lower peak-to-average magnitude ratios, which are indicative of a more noise-like (less tone-like) input audio signal. This second methodology provides a fine-grained approach, and may be utilized to any desired resolution level. Following step 275, in step 280, the method also determines the corresponding quantization levels and bit allocations for imperceptible distortion levels (generally, set to a level just less than or beneath JND) for the selected masked threshold, and the method may end, return step 285. In general, this method variation is also run continuously, with time-varying masked thresholds selected or determined, as the input audio signal is generally time varying.

In the various embodiments, rather than forming a ratio of peak-to-average magnitudes of the compressed spectral representation, direct comparisons may be performed equivalently. For example, a tone-like determination may be made when peak magnitude is greater than average magnitude by a predetermined threshold, while a noise-like determination may be made when peak magnitude is not greater than average magnitude by a predetermined threshold. Similarly, a degree of tonality may be determined by the degree to which peak magnitude is greater than average magnitude, i.e., using the difference between the peak magnitude and the average magnitude. In addition, depending upon the selected embodiment, various components of the compressed spectral representation, such as either the low pass or the high pass components, may be disregarded in determining the peak and average magnitudes of the compressed spectral representation. For example, in perceptual encoding of speech, the low pass components may be considered to be the periodicity of envelope distortion, and disregarded in determining peak and average magnitudes.

In another embodiment of the invention, the input audio may also be examined in frequency bands, such as Barks, with a separate tone-masked or noise-masked thresholds determined within each band (or Bark). With this methodology, an overall masked threshold is then assembled from each sub-band masked threshold. Those of skill in the art will recognize that numerous other equivalent variations are available and are within the scope of the present invention. Using any of the variations of the present invention, it should be understood that an overall, resulting masked threshold is determined or assembled for the entire relevant audio spectrum, which also may be based upon a plurality of individual thresholds that are determined with any desired level of granularity or resolution for any portion of (or frequency sub-band within) the audio spectrum.

In the various embodiments of the present invention, the tonality or harmonicity analysis using a compressed spectral operation may be combined or used in conjunction with other types of tonal analyses. For example, the compressed spectral methodology of the invention may be combined with spectral flatness measures, use of complex spectral coefficients, loudness uncertainty measures, and envelope fluctuation determinations, to provide a multifaceted determination of tonality.

As indicated above, the compressed spectral tonality analysis of the present invention is preferably implemental in the cepstral domain, resulting in cepstral sequence $\{c_x(n)\}$ (or a summation (or superposition) of cepstrum sequences, e.g., $\{c_x(n)\}=\{c_e(n)\}+\{c_h(n)\}$). Depending upon the selected embodiment, other methods of compressed spectral analysis (including other forms of homomorphic deconvolution) may also be utilized equivalently. Autocorrelation techniques may also be utilized, particularly to simplify calculations. The logarithmic operation for the cepstral technique may be performed in any base, such as base ten or base e (natural logarithm), and may use any spectral transformation (Fourier, FFT, DCT, z, and so on). Similarly, an exponential function or operation may be utilized to compress the magnitudes of the spectral representation (e.g., exponent between zero and one). The use of cepstral coefficients (or sequences) is particularly advantageous in speech and other audio signal processing, particularly when the cepstral sequences $\{c_e(n)\}$ and $\{c_h(n)\}$ are sufficiently different so that they can be separated in the cepstral domain. Specifically suppose that $\{c_h(n)\}$ has its main components (main energy) in the vicinity of small values of n, whereas $\{c_e(n)\}$ has it components concentrated at large values of n, such that $\{c_h(n)\}$ is "low pass" and $\{c_e(n)\}$ is "high pass". These two sequences may then be separated using appropriate low pass and high pass windows and, once separated, the inverse transformations may be obtained by passing the sequences through an inverse homomorphic system, such as by inverse Fourier transformation. Under various circumstances, the $\{c_h(n)\}$ may be representative of an envelope of a harmonic spectrum, for example, and may be separated from the harmonic input. Under other circumstances, such as speech synthesis, the $\{c_h(n)\}$ may be representative of a vocal tract spectrum, for example, and may be separated from the harmonic input.

Autocorrelation techniques may also be utilized with the present invention, as an additional step prior to the first and second frequency transformations. An autocorrelation of the input audio signal x(t) (or sequence x(n)) is computed to form an autocorrelation sequence $\Phi(m)$, which is then transformed into the frequency domain, such as through a Fourier transformation, $FFT(\Phi(m))$. As this result is indicative of the power density spectrum and related to the square of the magnitude of the frequency transformation of x(t) (i.e., $|FFT(x(t))|^2$), an optional square root may be performed on the frequency transformation of the autocorrelation sequence $$\left(\sqrt{FFT(\Phi(m))}\right).$$

A compression (or another compression) is then performed, such as $\log[FFT(\Phi(m))]$ (or, $$\text{optionally } \log\sqrt{FFT(\Phi(m))}$$

or an exponential compression such as $$\sqrt{\sqrt{FFT(\Phi(m))}}\Big).$$

This is followed by a second autocorrelation and then a second transformation (and optionally, a second square root). The peak and average magnitudes are then compared, as discussed above.

It should be noted that the use of the frequency transformation, magnitude compression, and inverse transformation, in accordance with the invention, results in a larger or more significant peak magnitude (compared to other methods such as a frequency transformation followed by an inverse transformation, without the magnitude compression of the invention). This results in a greater sensitivity for detecting the tonality, and the degrees of tonality, of the input audio signal. This greater sensitivity is illustrated below in the comparison of FIGS. 5 and 8 with FIGS. 6, 7 and 9, 10, respectively.

Figure 5:
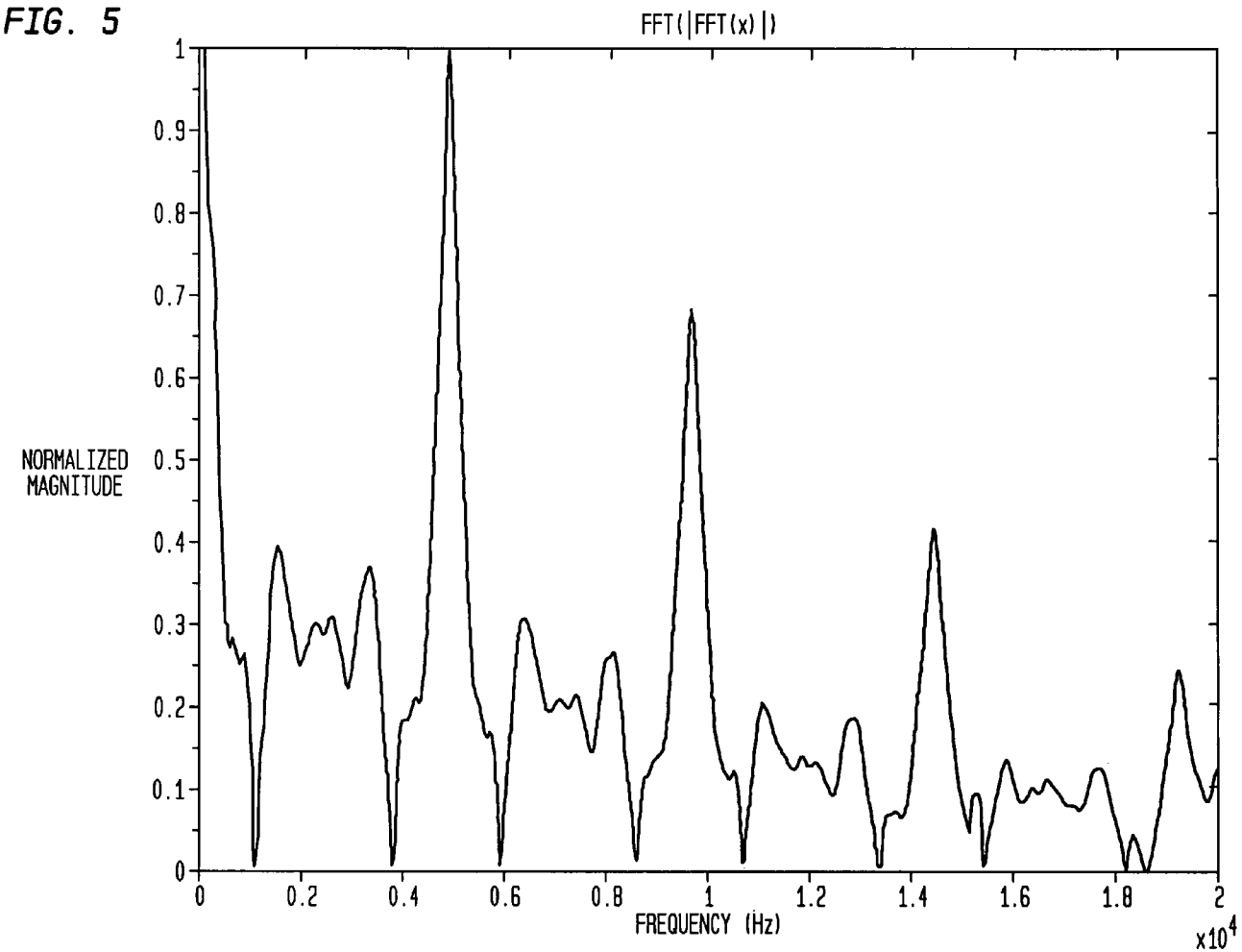
FIG. 5 is a graphical illustration of an exemplary normalized magnitude of FFT(|FFT(x)|) in the audio spectrum for a violoncello.
Figure 6:
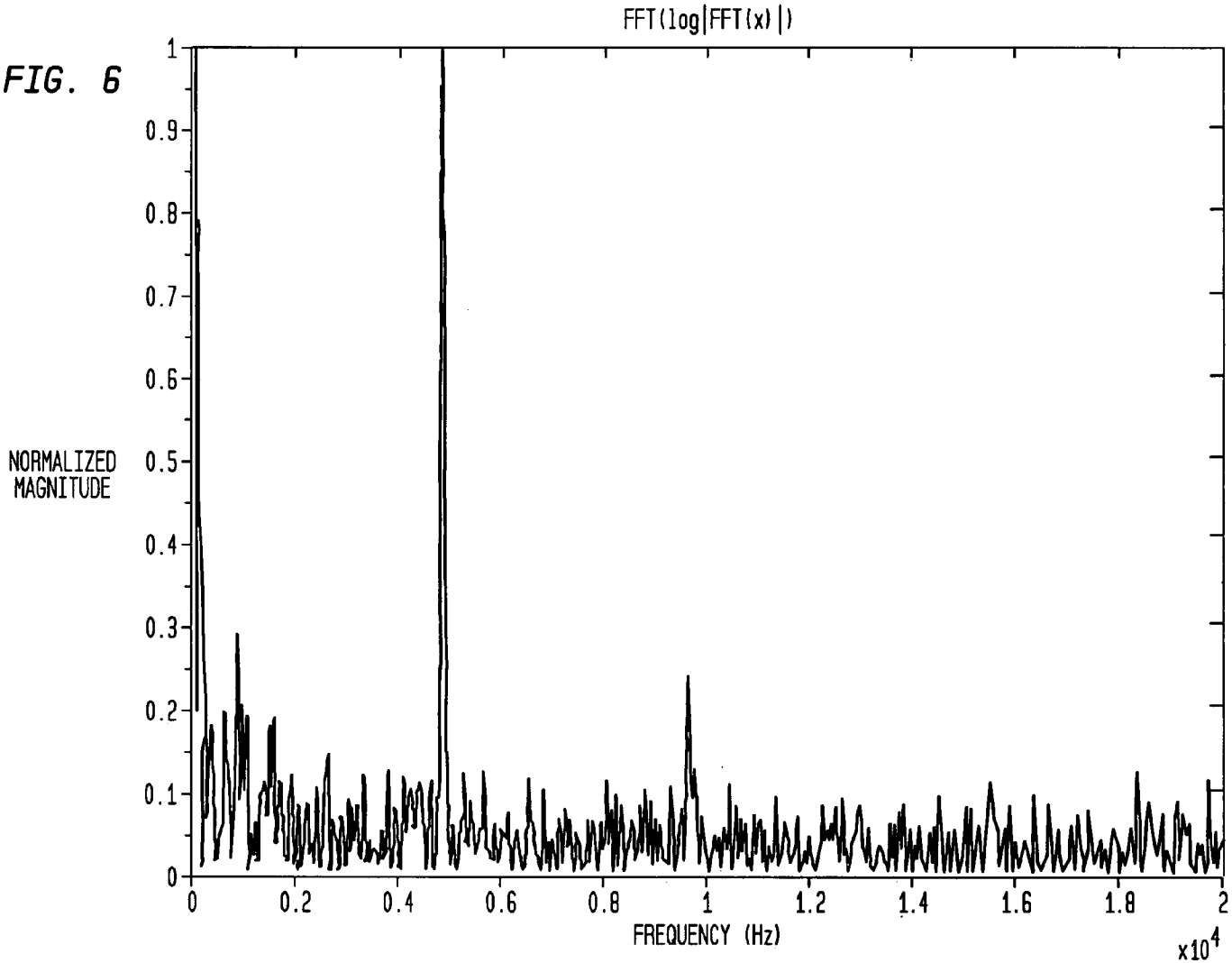
FIG. 6 is a graphical illustration of an exemplary normalized magnitude of FFT(log|FFT(x)|) in the audio spectrum for a violoncello, as a compressed spectral representation using a cepstrum operation in accordance with the present invention.
Figure 7:
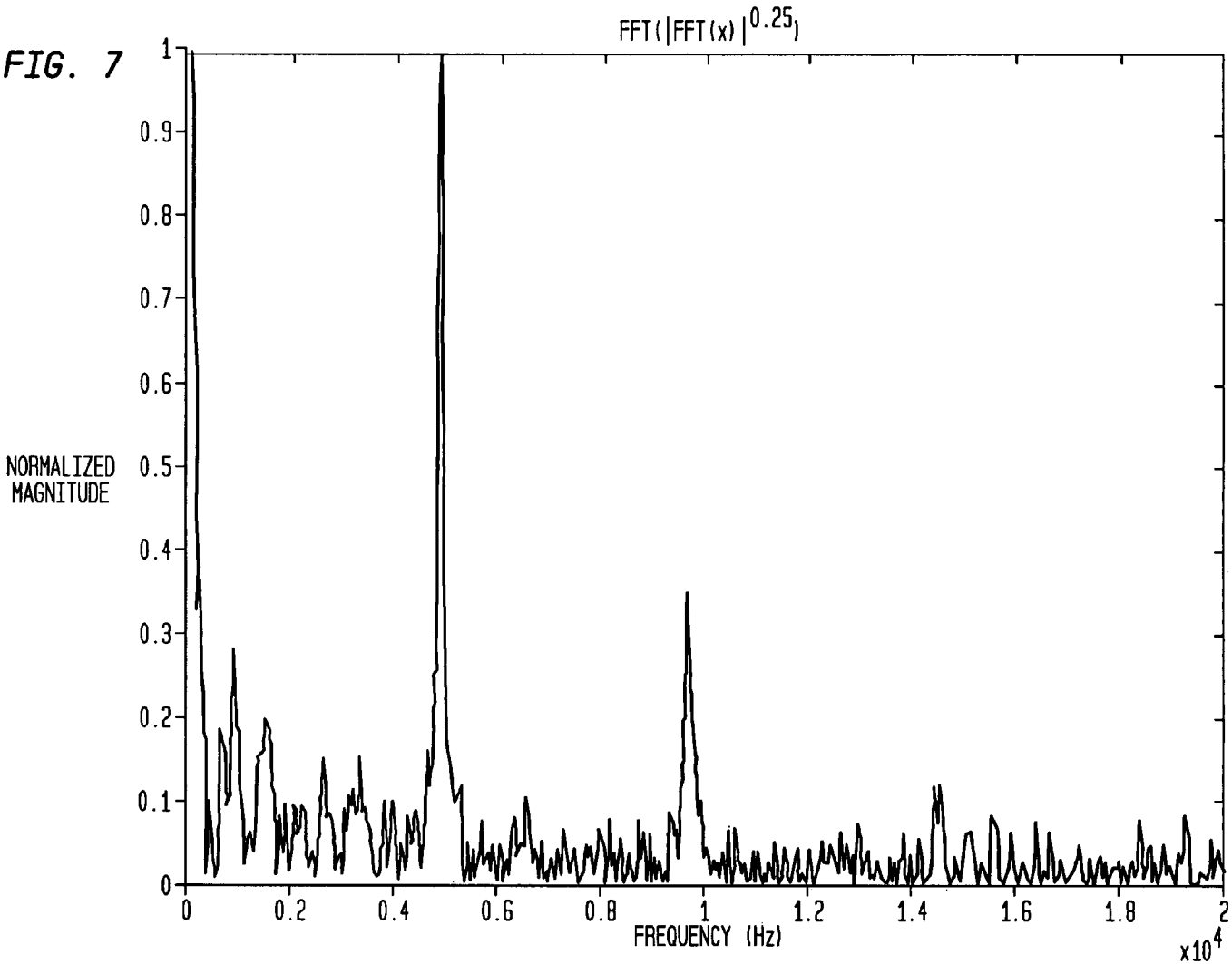
FIG. 7 is a graphical illustration of an exemplary normalized magnitude of FFT($|FFT(x)|^{0.25}$) in the audio spectrum for a violoncello, as a compressed spectral representation using an exponential operation in accordance with the present invention.
Figure 8:
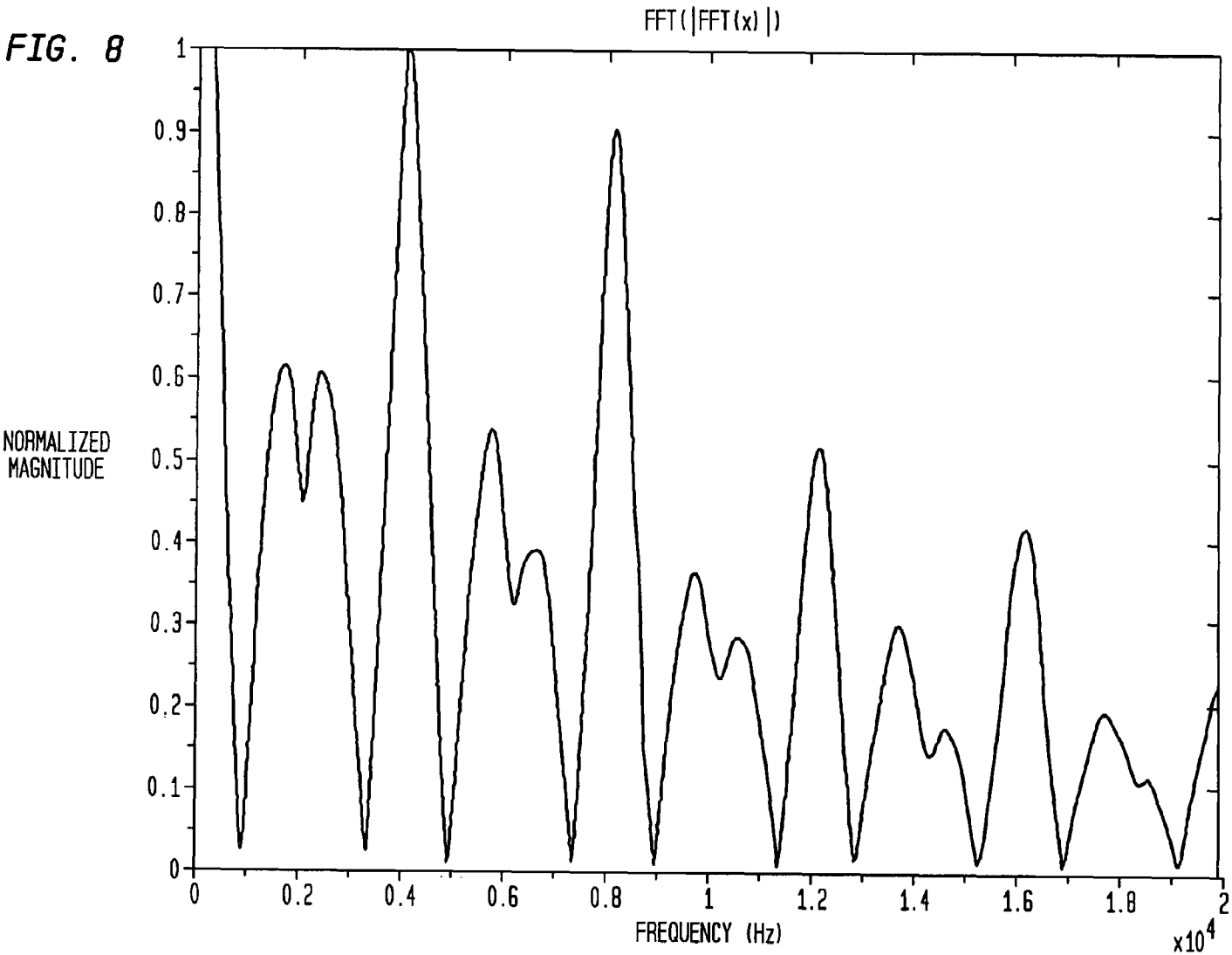
FIG. 8 is a graphical illustration of an exemplary normalized magnitude of FFT(|FFT(x)|) in the audio spectrum for a classical orchestra.
Figure 9:
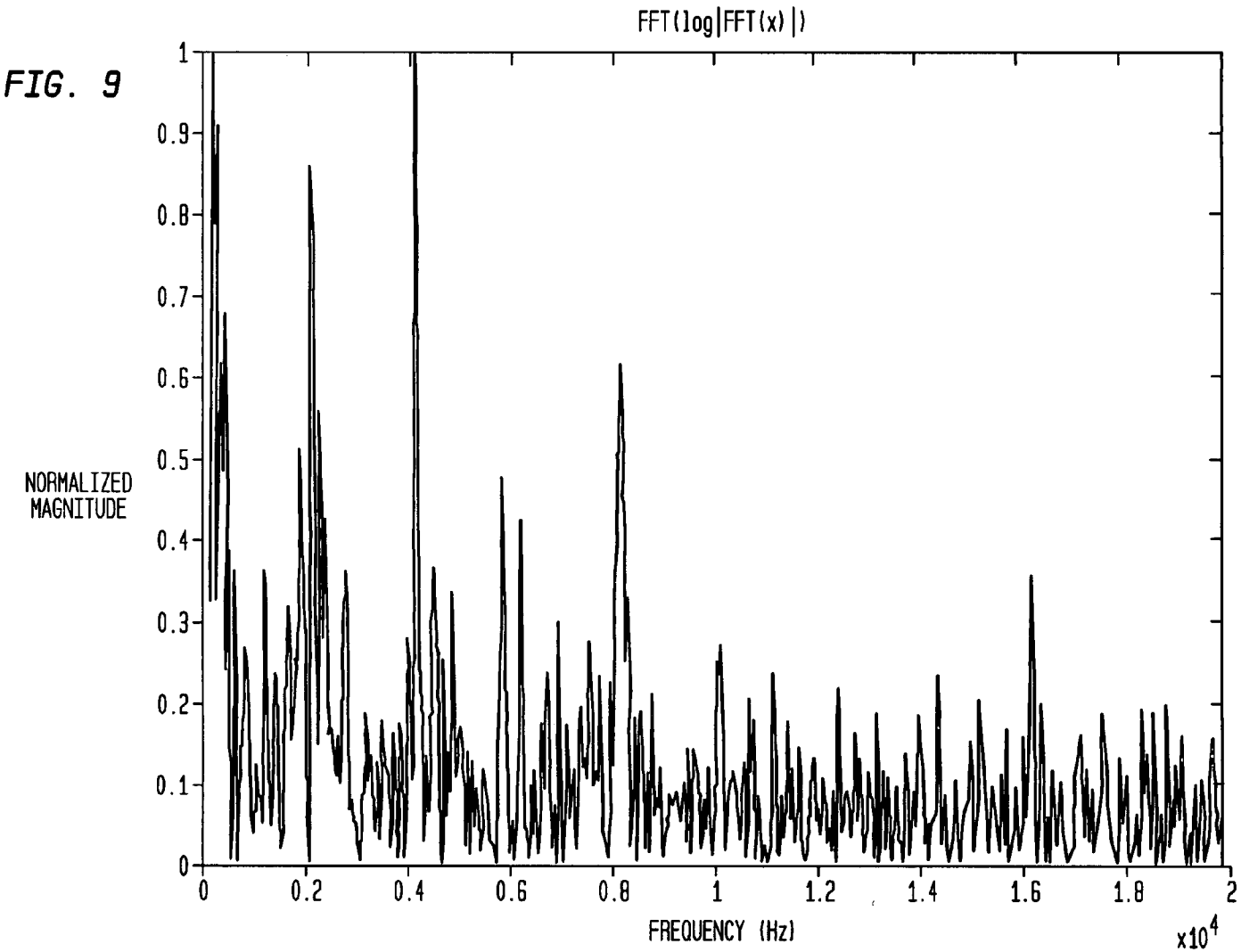
FIG. 9 is a graphical illustration of an exemplary normalized magnitude of FFT(log|FFT(x)|) in the audio spectrum for a classical orchestra, as a compressed spectral representation using a cepstrum operation in accordance with the present invention.
Figure 10:
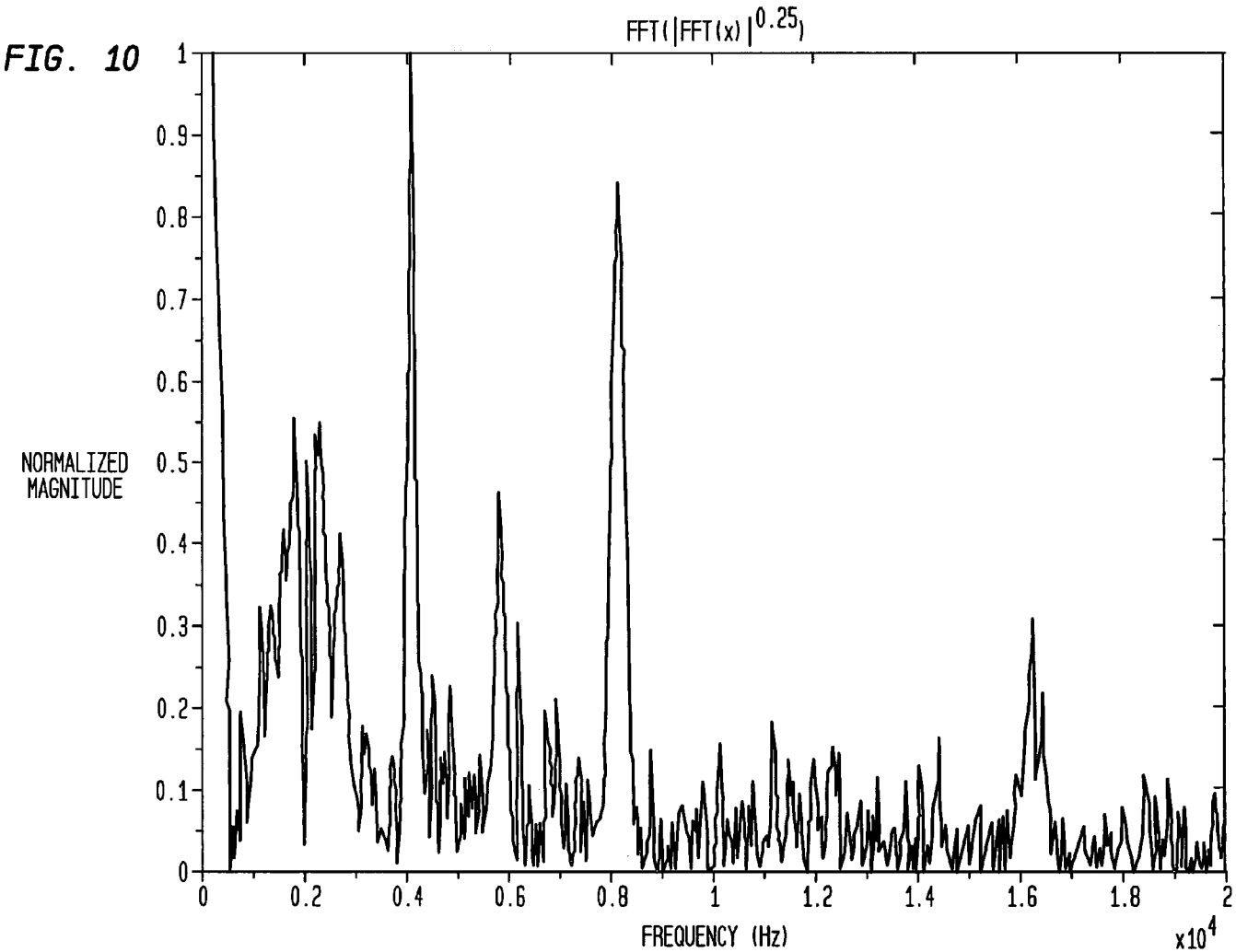
FIG. 10 is a graphical illustration of an exemplary normalized magnitude of FFT($|FFT(x)|^{0.25}$) in the audio spectrum for a classical orchestra, as a compressed spectral representation using an exponential operation in accordance with the present invention.

For FIGS. 5 through 10, input audio signals for a violoncello and for a classical orchestra were simulated. The input audio signals were sampled at a sampling rate of 44.1 kHz, using a frame (or block) of 1024 samples, an applied Hanning window, and an FFT of size 1024, with the result referred to as FFT(x). FIGS. 5 and 8 are graphical illustrations of exemplary normalized magnitudes of FFT(|FFT(x)|) in the audio spectrum for a violoncello and for a classical orchestra, respectively. FIGS. 6 and 9 are graphical illustrations of exemplary normalized magnitudes of FFT(log|FFT(x)|) in the audio spectrum for a violoncello and for a classical orchestra, respectively, as compressed spectral representations using a cepstrum operation in accordance with the present invention. FIGS. 7 and 10 are graphical illustrations of exemplary normalized magnitudes of FFT(|FFT(x)|$^{0.25}$) in the audio spectrum for a violoncello and for a classical orchestra, respectively, as compressed spectral representations using an exponential operation in accordance with the present invention. As illustrated, the compression methodology of the invention significantly magnifies the harmonic peaks and improves the peak-to-average ratios. In comparing these various illustrations, it is readily apparent that the harmonic peaks are significantly more pronounced and detectable in the compressed spectral representations of the present invention, resulting in greater sensitivity to and discrimination of harmonicity (and tonality) compared to other methods.

The methodologies of the invention discussed above may be embodied in any number of forms, such as within an encoder or a transmitter. In addition, the present invention may be embodied using any applicable type of circuitry, such as in a digital signal processor (DSP), an application-specific integrated circuit (ASIC), with memory. The memory is preferably an integrated circuit (such as random access memory (RAM) in any of its various forms such as SDRAM), but also may be a magnetic hard drive, an optical storage device, or any other type of data storage apparatus. The memory is used to store information obtained during the encoding process, and also may store information pertaining to program instructions or configurations, if any, utilized to program a DSP or other processor. The invention may be embodied using a single integrated circuit ("IC"), or may include a plurality of integrated circuits or other components connected, arranged or grouped together, such as microprocessors, DSPs, custom ICs, application specific integrated circuits ("ASICs"), field programmable gate arrays ("FPGAs"), associated memory (such as RAM and ROM), other ICs and components, or some other grouping of integrated circuits which have been configured or programmed to perform the functions discussed above, with associated memory, such as microprocessor memory or additional RAM, DRAM, SRAM, MRAM, ROM, EPROM or $E^2$PROM. In selected embodiments, the invention is implemented in its entirety as an ASIC, which is configured (hard-wired) through its design (such as gate and interconnection layout) to implement the methodology of the invention, with associated memory, or such an ASIC in conjunction with a DSP.

In addition, the methodologies may be embodied within any tangible storage medium, such as within a memory or storage device for use by an encoder, a transmitter, a computer, a workstation, any other machine-readable medium or form, or any other storage form or medium for use in encoding audio signals. Such storage medium, memory or other storage devices may be any type of memory device, memory integrated circuit ("IC"), or memory portion of an integrated circuit as mentioned above, or any other type of memory, storage medium, or data storage apparatus or circuit, depending upon the selected embodiment. For example, without limitation, a tangible medium storing computer readable software, or other machine-readable medium, may include a floppy disk, a CDROM, a CD-RW, a magnetic hard drive, an optical drive, a quantum computing storage medium or device, a transmitted electromagnetic signal (e.g., a computer data signal embodied in a carrier wave used in internet downloading), or any other type of data storage apparatus or medium, and may have a static embodiment (such as in a memory or storage device) or may have a dynamic embodiment (such as a transmitted electrical signal), or their equivalents.

Numerous advantages of the present invention may be readily apparent. Most important, use of the present invention provides greater reliability in tonality analysis, resulting in improved coding efficiencies and higher quality audio transmission, storage, and output. Secondly, depending upon the selected embodiment, the present invention will also provide a deconvolution of the input audio signal into separate components, which may be advantageous in certain encoding or analysis environments.

From the foregoing, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

It is claimed:

1. A method for performing perceptual audio encoding on an input audio signal, the method comprising:

(a) sampling the input audio signal to generate multiple sampled frames;

(b) performing a first frequency transformation of each sampled frame into a frequency do main representation of the sample frame;

(c) applying a magnitude compression operation to the frequency domain representation of each sampled frame to form a magnitude-compressed representation of the sample frame;

(d) performing a second frequency transformation of the magnitude-compressed representation of each sampled frame to form a compressed spectral representation of the sample frame;

(e) determining tonality of each sampled frame from a peak magnitude and an average magnitude of the compressed spectral representation of the sampled frame to distinguish tone-like components in the input audio signal from noise-like components in the input audio signal;

(f) selecting a masked threshold for each sampled frame corresponding to the determined tonality of the sampled frame, wherein masked thresholds selected for the tone-like components in the input audio signal are different from masked thresholds selected for the noise-like components in the input audio signal; and (g) performing perceptual audio encoding on the sampled frames based on the selected masked thresholds to compress the tone-like features in the input audio signal at a different level of compression from the noise-like features in the input audio signal.

2. The invention of claim 1, wherein:

the first frequency transformation is a forward frequency transformation; and the second frequency transformation is an inverse frequency transformation.

3. The invention of claim 2, wherein:

the forward frequency transformation is a Fourier transformation, a fast Fourier transformation (FFT), a discrete cosine transformation (DCT), or a z-transformation; and the inverse frequency transformation is an inverse Fourier transformation, an inverse FFT, an inverse DCT, or an inverse z-transformation.

4. The invention of claim 1, wherein:

the first frequency transformation is a first forward frequency transformation; and the second frequency transformation is a second forward frequency transformation.

5. The invention of claim 4, wherein:

the first forward frequency transformation is a Fourier transformation, an FFT, a DCT, or a z-transformation; and the second forward frequency transformation is a Fourier transformation, an FFT, a DCT, or a z-transformation.

6. The invention of claim 1, wherein the magnitude compression operation is a logarithmic compression operation.

7. The invention of claim 1, wherein the magnitude compression operation is an exponential compression operation.

8. The invention of claim 1, wherein, for each sampled frame, step (e) comprises:

(e1) determining a ratio based on the peak magnitude and the average magnitude of the compressed spectral representation of the sampled frame; and (e2) determining the tonality of the sampled frame based on the ratio.

9. The invention of claim 8, wherein, for each sampled frame:

step (e2) comprises comparing the ratio to a specified threshold level to determine whether to identify the tonality of the sampled frame as substantially tone-like or substantially noise-like; and step (f) comprises:

(f1) selecting a tone-masked threshold for the masked threshold if the tonality of the sampled frame is identified as primarily tone-like; and (f2) selecting a noise-masked threshold for the masked threshold if the tonality of the sampled frame is identified as primarily noise-like.

10. The invention of claim 8, wherein, for each sampled frame:

step (e2) comprises using the ratio to determine a degree to which the sampled frame is tone-like or noise-like; and step (f) comprises selecting the masked threshold as a function of the degree of the tonality of the sampled frame.

11. The invention of claim 1, wherein, for each sampled frame, step (e) comprises:

(e1) determining a difference between the peak magnitude and the average magnitude of the compressed spectral representation of the sampled frame; and (e2) determining the tonality of the sampled frame based on the difference.

12. The invention of claim 11, wherein, for each sampled frame:

step (e2) comprises comparing the difference to a specified threshold level to determine whether to identify the tonality of the sampled frame as primarily tone-like or primarily noise-like; and step (f) comprises:

(f1) selecting a tone-masked threshold for the masked threshold if the tonality of the sampled frame is identified as primarily tone-like; and (f2) selecting a noise-masked threshold for the masked threshold if the tonality of the sampled frame is identified as primarily noise-like.

13. The invention of claim 11, wherein, for each sampled frame:

step (e2) comprises using the difference to determine a degree to which the tonality of the sampled frame is tone-like or noise-like; and step (f) comprises selecting the masked threshold as a function of the degree of the tonality of the sampled frame.

14. The invention of claim 1, wherein step (g) comprises using the selected masked thresholds to encode the sampled frames with a distortion spectrum beneath a level of just noticeable distortion (JND).

15. The invention of claim 1, wherein step (g) comprises using the selected masked thresholds to determine quantization levels and bit allocations for quantizing and encoding the sampled frames.

16. The invention of claim 1, wherein steps (e) and (f) are implemented independently for different frequency bands in the compressed spectral representation of each sampled frame to select a masked threshold for each different frequency band in the sampled frame.

17. The invention of claim 1, wherein step (b) comprises performing an autocorrelation function on each sampled frame prior to performing the first frequency transformation.

18. The invention of claim 1, wherein the determined tonality of each sampled frame is a measure of harmonicity of the sampled frame.

19. The invention of claim 1, wherein step (e) comprises determining the tonality of each sampled frame from only a portion of the spectral components of the compressed spectral representation of the sampled frame.

20. The invention of claim 1, wherein the compressed spectral representation of each sampled frame comprises at least one cepstral sequence.

21. An apparatus for performing perceptual audio encoding on an input audio signal, the apparatus comprising:

a sampler adapted to sample the input audio signal to generate multiple sampled frames;

a psychoacoustic analyzer adapted to (1) perform a first frequency transformation of each sampled frame into a frequency domain representation of the sampled frame, (2) apply a magnitude compression operation to the frequency domain representation of each sampled frame to form a magnitude-compressed representation of the sampled frame, (3) perform a second frequency transformation of the magnitude-compressed representation of each sampled frame to form a compressed spectral representation of the sampled frame, (4) determine tonality of each sampled frame from a peak magnitude and an average magnitude of the compressed spectral representation of the sampled frame to distinguish tone-like components in the input audio signal from noise-like components in the input audio signal, and (5) select a masked threshold for each sampled frame corresponding to the determined tonality of the sampled frame, wherein masked thresholds selected for the tone-like components in the input audio signal are different from masked thresholds selected for the noise-like components in the input audio signal; and an encoder adapted to perform perceptual audio encoding on the sampled frames based on the selected masked thresholds to compress the tone-like features in the input audio signal at a different level of compression from the noise-like features in the input audio signal.

22. The invention of claim 21, wherein:

the first frequency transformation is a forward frequency transformation; and the second frequency transformation is an inverse frequency transformation.

23. The invention of claim 22, wherein:

the forward frequency transformation is a Fourier transformation, a fast Fourier transformation (FFT), a discrete cosine transformation (DCT), or a z-transformation; and the inverse frequency transformation is an inverse Fourier transformation, an inverse FFT, an inverse DCT, or an inverse z-transformation.

24. The invention of claim 21, wherein:

the first frequency transformation is a first forward frequency transformation; and the second frequency transformation is a second forward frequency transformation.

25. The invention of claim 24, wherein:

the first forward frequency transformation is a Fourier transformation, an FFT, a DCT, or a z-transformation; and the second forward frequency transformation is a Fourier transformation, an FFT, a DCT, or a z-transformation.

26. The invention of claim 21, wherein the magnitude compression operation is a logarithmic compression operation.

27. The invention of claim 21, wherein the magnitude compression operation is an exponential compression operation.

28. The invention of claim 21, wherein, for each sampled frame, the psychoacoustic analyzer is adapted to:

determine a ratio based on the peak magnitude and the average magnitude of the compressed spectral representation of the sampled frame; and determine the tonality of the sampled frame based on the ratio.

29. The invention of claim 28, wherein, for each sampled frame, the psychoacoustic analyzer is adapted to:

compare the ratio to a specified threshold level to determine whether to identify the tonality of the sampled frame as substantially tone-like or substantially noise-like;

select a tone-masked threshold for the masked threshold if the tonality of the sampled frame is identified as primarily tone-like; and select a noise-masked threshold for the masked threshold if the tonality of the sampled frame is identified as primarily noise-like.

30. The invention of claim 28, wherein, for each sampled frame, the psychoacoustic analyzer is adapted to:

use the ratio to determine a degree to which the sampled frame is tone-like or noise-like; and select the masked threshold as a function of the degree of the tonality of the sampled frame.

31. The invention of claim 21, wherein, for each sampled frame, the psychoacoustic analyzer is adapted to:

determine a difference between the peak magnitude and the average magnitude of the compressed spectral representation of the sampled frame; and determine the tonality of the sampled frame based on the difference.

32. The invention of claim 31, wherein, for each sampled frame, the psychoacoustic analyzer is adapted to:

compare the difference to a specified threshold level to determine whether to identify the tonality of the sampled frame as primarily tone-like or primarily noise-like;

select a tone-masked threshold for the masked threshold if the tonality of the sampled frame is identified as primarily tone-like; and select a noise-masked threshold for the masked threshold if the tonality of the sampled frame is identified as primarily noise-like.

33. The invention of claim 31, wherein, for each sampled frame, the psychoacoustic analyzer is adapted to:

use the difference to determine a degree to which the tonality of the sampled frame is tone-like or noise-like; and select the masked threshold as a function of the degree of the tonality of the sampled frame.

34. The invention of claim 21, wherein the encoder is adapted to use the selected masked thresholds to encode the sampled frames with a distortion spectrum beneath a level of just noticeable distortion (JND).

35. The invention of claim 21, wherein the encoder is adapted to use the selected masked thresholds to determine quantization levels and bit allocations for quantizing and encoding the sampled frames.

36. The invention of claim 21, wherein, for each sampled frame, the psychoacoustic analyzer is adapted to determine the tonality of the sampled frame independently for different frequency bands in the compressed spectral representation of the sampled frame to select a masked threshold for each different frequency band in the sampled frame.

37. The invention of claim 21, wherein, for each sampled frame, the psychoacoustic analyzer is adapted to perform an autocorrelation function on the sampled frame prior to performing the first frequency transformation.

38. The invention of claim 21, wherein the determined tonality of each sampled frame is a measure of harmonicity of the sampled frame.

39. The invention of claim 21, wherein, for each sampled frame, the psychoacoustic analyzer is adapted to determine the tonality of the sampled frame from only a portion of the spectral components of the compressed spectral representation of the sampled frame.

40. The invention of claim 21, wherein the compressed spectral representation of each sampled frame comprises at least one cepstral sequence.

41. The invention of claim 21, wherein the apparatus is an encoder.

42. The invention of claim 21, wherein the apparatus is a transmitter.

43. Apparatus for performing perceptual audio encoding on an input audio signal, the apparatus comprising:

means for sampling the input audio signal to generate multiple sampled frames;

means for performing a first frequency transformation of each sampled frame into a frequency domain representation of the sample frame;

means for applying a magnitude compression operation to the frequency domain representation of each sampled frame to form a magnitude-compressed representation of the sample frame;

means for performing a second frequency transformation of the magnitude-compressed representation of each sampled frame to form a compressed spectral representation of the sample frame;

means for determining tonality of each sampled frame from a peak magnitude and an average magnitude of the compressed spectral representation of the sampled frame to distinguish tone-like components in the input audio signal from noise-like components in the input audio signal;

means for selecting a masked threshold for each sampled frame corresponding to the determined tonality of the sampled frame, wherein masked thresholds selected for the tone-like components in the input audio signal are different from masked thresholds selected for the noise-like components in the input audio signal; and means for performing perceptual audio encoding on the sampled frames based on the selected masked thresholds to compress the tone-like features in the input audio signal at a different level of compression from the noise-like features in the input audio signal.

* * * * *